US008847077B2

(12) United States Patent
Emilsson

(10) Patent No.: US 8,847,077 B2
(45) Date of Patent: Sep. 30, 2014

(54) HIGH VOLTAGE BUSHING WITH SUPPORT FOR THE CONDUCTOR

(75) Inventor: David Emilsson, Ludvika (SE)

(73) Assignee: ABB Technology Ltd. (CH)

( * ) Notice: Subject to any disclaimer, the term of this patent is extended or adjusted under 35 U.S.C. 154(b) by 0 days.

(21) Appl. No.: 14/004,830

(22) PCT Filed: Jan. 31, 2012

(86) PCT No.: PCT/EP2012/051511
§ 371 (c)(1),
(2), (4) Date: Sep. 12, 2013

(87) PCT Pub. No.: WO2012/123163
PCT Pub. Date: Sep. 20, 2012

(65) Prior Publication Data

US 2014/0000936 A1 Jan. 2, 2014

(30) Foreign Application Priority Data

Mar. 16, 2011 (EP) ..... 11158377

(51) Int. Cl.
*H01B 17/26* (2006.01)
*H01B 17/42* (2006.01)
*H01B 17/36* (2006.01)

(52) U.S. Cl.
CPC ..... *H01B 17/26* (2013.01); *H01B 17/42* (2013.01); *H01B 17/36* (2013.01)
USPC ..... 174/152 R; 174/14 BH; 174/11 BH; 174/142

(58) Field of Classification Search
CPC .. B60R 16/0215; B60R 16/0222; H02G 3/24; H02G 3/30; H02G 3/36; H01B 17/42; H01B 17/00; H01B 17/005; H01B 17/26; H01B 17/265; H01B 17/301; H01B 17/34; H01B 17/56; H01B 17/28
USPC ..... 174/650, 152 R, 153 G, 152 G, 14 BH, 174/12 BH, 15.3, 142, 137 B, 143, 50.63, 174/137 R; 16/2.1, 2.2; 248/56
See application file for complete search history.

(56) References Cited

U.S. PATENT DOCUMENTS 4,523,052 A 6/1985 Takahashi et al.
5,170,885 A * 12/1992 Guenther et al. ..... 174/50.63

(Continued)

FOREIGN PATENT DOCUMENTS

EP 2264719 A1 12/2010
JP 2000331545 A 11/2000
WO 2010097887 A1 9/2010

OTHER PUBLICATIONS

European Search Report Application No. EP 11 15 8377 Completed: Aug. 4, 2011; Mailing Date: Aug. 18, 2011 6 pages.

(Continued)

*Primary Examiner* — Angel R Estrada
(74) *Attorney, Agent, or Firm* — St. Onge Steward Johnston & Reens LLC

(57) ABSTRACT

A high voltage gas isolated bushing including a tubular shell with an end flange at each end of the shell creating an enclosed volume, a conductor suspended in the enclosed volume, having two ends, one end fixed to one end flange at a first fixation point and the other end fixed to the other end flange at a second fixation point. At least one of the end flanges is provided with a support body extending into the enclosed volume in the longitudinal direction of the bushing, and the body is arranged to support the conductor on at least one support point at a distance from the fixation point on the flange.

15 Claims, 3 Drawing Sheets

(56) References Cited

U.S. PATENT DOCUMENTS

| | | | | |
|---|---|---|---|---|
| 5,466,891 | A * | 11/1995 | Freeman et al. | 174/142 |
| 6,627,820 | B2 * | 9/2003 | Yanagisawa et al. | 174/137 R |
| 8,134,089 | B2 * | 3/2012 | Roseen et al. | 174/153 G |
| 8,389,876 | B2 * | 3/2013 | Emilsson et al. | 174/152 R |
| 8,471,150 | B2 * | 6/2013 | Emilsson et al. | 174/143 |
| 8,637,773 | B2 * | 1/2014 | Jonsson et al. | 174/137 B |
| 2010/0018752 | A1 | 1/2010 | Emilsson et al. | |

OTHER PUBLICATIONS

ABB Components: "Gas Insulated Wall Bushing, Type GGFL, Installation and Maintenance Guide"; Dec. 7, 2010; 13 pages.

International Search Report & Written Opinion of the International Searching Authority Application No. PCT/EP2012/051511 Completed: Apr. 18, 2012; Mailing Date: Apr. 25, 2012 11 pages.

* cited by examiner

HIGH VOLTAGE BUSHING WITH SUPPORT FOR THE CONDUCTOR

TECHNICAL FIELD

The present invention relates to the field of high voltage technology, and in particular to gas insulated high voltage bushings.

BACKGROUND

Gas insulated High Voltage bushings are used for carrying current at high potential through a plane, often referred to as a grounded plane, where the plane is at a different potential than the current path. Bushings are designed to electrically insulate a high voltage conductor, located inside the bushing, from the grounded plane. The grounded plane can for example be a transformer tank or a wall, such as for example a High Voltage Direct Current (HVDC) valve hall wall. An example of a gas isolated bushing is the GGFL, air to air bushing, by ABB.

In a gas filled bushing with a free hanging conductor, for example, a wall bushing, the maximum deflection of the conductor in the longitudinal center of the bushing influences the inner diameter of the bushing which affects the outer diameter of the bushing. In order to prevent flashovers, the higher the maximum deflection is the larger the inside diameter of the bushing has to be. Inside of the bushing, different field control shields are arranged to handle the electrical fields. The field control shields will not work as designed if the conductor is not in the radial center or close to the radial center of the bushing. There is thus a need to minimize the deflection of the conductor in very long bushings.

The static deflection of the conductor is generated by gravity and mass of the conductor itself. The conductor in the bushing is in the form of a tube fixed in both ends. The deflection of a horizontally or near horizontally placed tube is dependent on material constants of the conductor tube (Young's modulus and density), length, wall thickness and diameter of the tube.

The conductor is dimensioned to conduct a current i.e. for a given current and resistivity, the cross sectional area of the conductor is given. For a conductor of a given outer diameter, the wall thickness will be determined by the cross sectional area of the tube. The length is set by the length of the bushing which is determined by external electric requirements e.g. voltages and flashover distances. For large currents it is in principle only possible to use copper or aluminium or alloys thereof in the conductor. This will determine the material parameter which will then set the maximum stiffness of the material. Almost all material parameters and construction parameters are set by the electric requirements of the bushing.

To minimize the static deflection of the conductor at the longitudinal center, a number of solutions have been proposed. The tension of the conductor can be increased but this has only a limited effect on the static deflection. Horizontally moving the fixation point, where the conductor is fixed onto the end flange of the bushing, up from the radial center of the bushing will reduce the deflection at the longitudinal center point. The increasing voltages and very high power distributions that today's equipment has to handle make today's bushing very long, 10-20 m or even longer. For very long bushings, with large static deflection, the required shift of fixation point to solve the static deflection problem becomes too large to be practical.

SUMMARY OF THE INVENTION

Various aspects of the invention are set out in the accompanying claims.

The present invention provides a bushing that reduces the static deflection of the conductor at the longitudinal center of the bushing.

According to the present invention there is provided a high voltage bushing comprising; a tubular shell with an end flange at each end of the shell creating a enclosed volume, a conductor suspended in the enclosed volume, having two ends, one end fixed to one end flange at a first fixation point and the other end fixed to the other end flange at a second fixation point. At least one of the end flanges is provided with a support body extending into the enclosed volume in the longitudinal direction of the bushing, and the body is arranged to support the conductor on at least one support point at a distance from the fixation point on the flange.

The advantage of this embodiment is that the unsupported length of the conductor is reduced and thereby the static deflection at the longitudinal center of the bushing is reduced. In the present invention the fixation point on the end flange does not have to take up any moment and the fixation arrangement for the conductor can be made simpler and lighter offsetting the additional weight of the supporting body. The support by the body of the conductor may be on one single point or several points or a support surface. The several support points might be distributed along the conductor between the support point and the fixation point. The several points may be both on the lower and upper side of the conductor in the mounted bushing.

According to an embodiment of the invention, the support body is arranged around the conductor and one end of the body is fixated to the end flange and the other end of the body is provided with an opening for the conductor, where the opening forms the support point. The body might be rotationally symmetric around the conductor and/or the longitudinal center line of the bushing.

The advantage of this embodiment is that the body is equally supporting independent of if the bushing is rotated and fixing the base of the body on the end flange makes the body stable.

According to an embodiment of the invention, the support body is made from electrically insulating material such as fiber reinforced polymer or carbon or glass fiber reinforced epoxy.

The advantage of this embodiment is that the body does not affect the electrical fields.

According to an embodiment of the invention, the support body is made from metal. The advantage of this embodiment is the mechanical stiffness of metal, such as steel, in some cases makes a better, stiffer support body.

According to an embodiment of the invention, the support body is conically shaped and arranged around the conductor, the round base of the conically shaped body is fixed onto the end flange and the top of the conically shaped body is provided with an opening for the conductor, where the opening forms the support point.

The advantage of this embodiment is that the base of the body has a large fixation and support area and the conical form is mechanically good at taking up forces from the support point. In one embodiment the support body comprises several conically shaped bodies stacked on top of each other, all fixed onto the end flange, creating several support points along the conductor between the support point and the fixation point.

According to an embodiment of the invention, the tubular shell has a longitudinal center line and the body is arranged with the support point at a distance from the center line and so that the support point is positioned above the centerline when the bushing is mounted.

The advantage of this embodiment is that by arranging the support point above the center line, the static deflection at the longitudinal center of the bushing is minimized.

According to an embodiment of the invention, the tubular shell has a longitudinal center line and the fixation point is at a distance from the center line and so that the fixation point is positioned below the centerline when the bushing is mounted.

The advantage of this embodiment is that by arranging the fixation point below the center line, the conductor experiences a moment at the support point that minimizes static deflection at the longitudinal center of the bushing.

According to an embodiment of the invention, the fixation point and the support point are positioned on opposite sides of the centerline.

According to an embodiment of the invention, the distance between the support point and the fixation point at the end flange is in the interval 0.3 m-4 m.

According to an embodiment of the invention, the body comprises openings that allow the gas inside the bushing to circulate inside the support body. The advantage of this embodiment is that allows cooling of the part of the conductor that is surrounds by the support body.

According to an embodiment of the invention, the bushing is filled with SF6, sulfur hexafluoride, at an over pressure.

According to an embodiment of the invention, the support body is fixated on the end flange and comprises one or more support members, supporting the support body on the inner wall of the tubular shell.

According to an embodiment of the invention, the other of the end flanges is provided with a support body extending into the enclosed volume in the longitudinal direction of the bushing, and the body is arranged to support the conductor at a second support point at a distance from the fixation point on the flange.

Although various aspects of the invention are set out in the accompanying independent claims, other aspects of the invention include the combination of any features presented in the described embodiments and/or in the accompanying claims, and not solely the combinations explicitly set out in the accompanying claims.

BRIEF DESCRIPTION OF THE DRAWINGS

The drawings constitute a part of this specification and include exemplary embodiments to the invention, which may be embodied in various forms.

DETAILED DESCRIPTION

Figure 1:
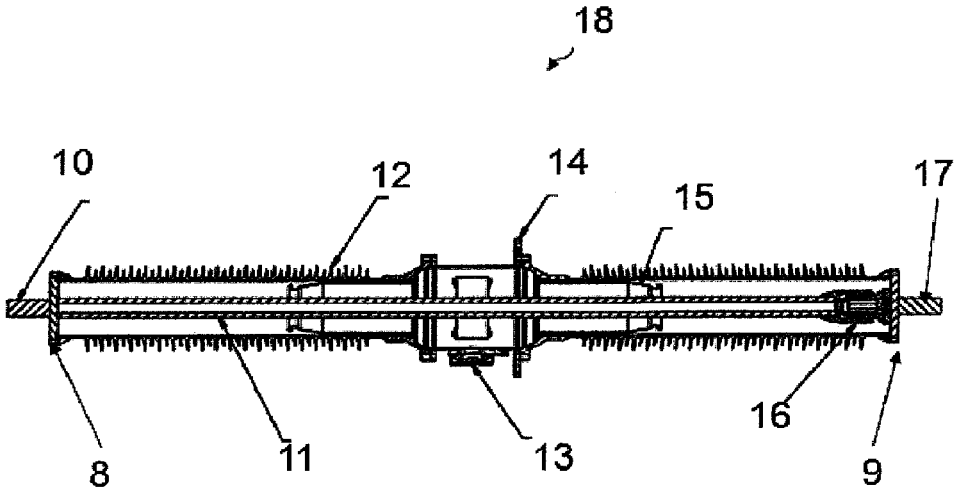
Prior Art Fig 1
FIG. 1 shows a gas insulated bushing where the present invention could be used.

FIG. 1 shows a gas insulated bushing 18 according to the prior art where the present invention could be used. The bushing comprises a tubular shell 12 assembled with an intermediate flange 14, also known as wall flange which could be made from welded aluminium, fitted with two insulators, one for each side of the wall flange. Grading of the electrical field is accomplished by internal shields 15 which could be conical aluminium shields and this whole arrangement can be seen as a hollow insulator or tubular shell. The insulators can be made of a glass fiber reinforced epoxy in the form of a tube that can be covered by weather sheds made of silicone rubber or other suitable material. The tubes are manufactured in one piece and equipped with end flanges 8, 9 at both ends, the end flanges 8, 9 can be glued on and made from cast aluminium. The design gives a rigid bushing with excellent mechanical properties. The hollow conductor 11, extends through the hollow shell 12 and is fixed at both ends on the end flanges 8, 9 at a fixation point and the conductor is unsupported between the fixation points. The bushing can be filled with isolating gas e.g. SF6 (sulfur hexafluoride). The isolating gas can be at atmospheric pressure or at an over pressure. The bushing is practically rotationally symmetric.

Figure 2:
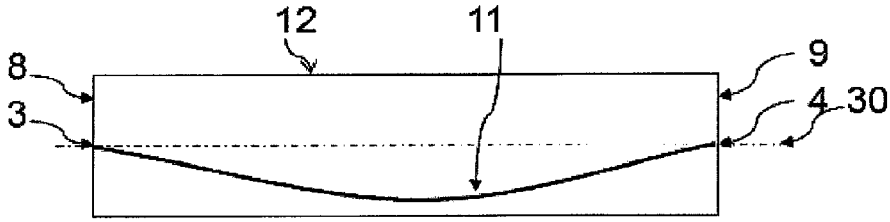
Prior Art Fig 2
FIG. 2 shows the problem that the present invention tries to solve.

FIG. 2 shows the problem, not in scale, that the present invention tries to solve. The fixation of the conductor 11 onto the end flanges 8, 9 is normally rigid so that the fixation point 3, 4 can support bending moment.

The dashed line 30 is the longitudinal center line of the bushing and the placement for the conductor without static deflection caused by gravity and the mass of the conductor. Dependent on the length of the bushing and thereby the unsupported length of the conductor, the static deflection at the longitudinal center of the bushing will be different. As the length of the bushing increases, the deflection at the longitudinal center of the bushing will increase dramatically. For bushings longer than 10-20 m the deflection might be so large that the voltage grading shields 15 might not work properly.

Figure 3:
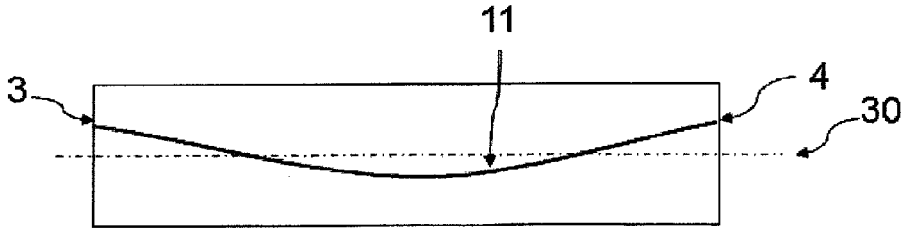
Prior Art Fig 3
FIG. 3 shows a prior art solution.

FIG. 3 shows a prior art solution to overcome the problems described in FIG. 2 whereby the fixation point of the end flange is shifted up in the vertical direction. The shift in fixation point can be on only one end flange or on both end flanges. This shift reduces the static deflection at the longitudinal center of the bushing. If the fixation point is shifted on one side the reduction of static deflection will be half amount that the fixation point was shifted and if both the fixation points are shifted, the reduction of static deflection at longitudinal center will be approximately the same amount that the fixation points were shifted. There is a limit on how much one can shift the fixation point so this solution is limited to medium length bushings.

Other solutions known in the prior art is to increase the tension in the conductor or change the construction of the conductor e.g. make the diameter of the conductor larger. All these solutions might not be sufficient for the longest bushings for the highest voltages.

Figure 4:
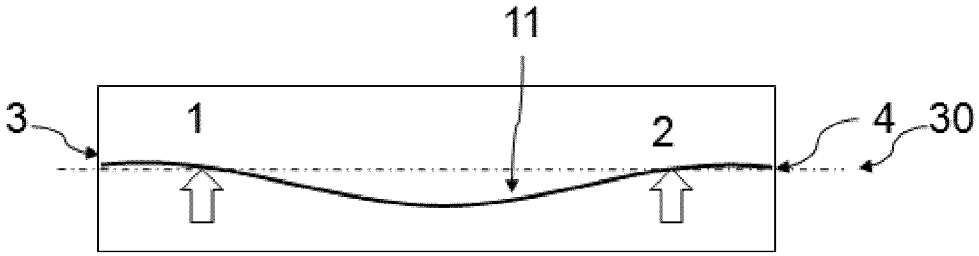
FIG. 4 shows an embodiment of the present invention.

FIG. 4 shows an embodiment of the present invention where the conductor 11 is supported at two points 1, 2 inside the hollow isolator 12 by a supporting body. The fixation point and the support points are placed on the longitudinal center line. The static deflection at the longitudinal center of the bushing is lowered by the additional support points. In the prior art solutions, the fixation point on the end flange have to be strong enough to take up moment that appear in the joint by static deflection of the conductor. In the present invention the fixation point only has to take vertical forces and tension in the longitudinal direction. This allows one to make the joint in the fixation point simpler and weaker which would allow one to save weight on the end flange that may compensate for the weight added by the supporting body.

Figure 5:
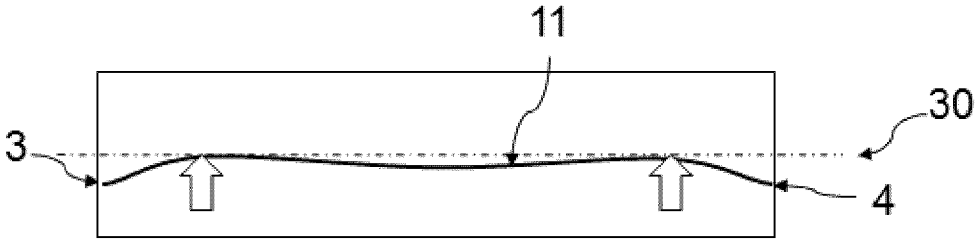
FIG. 5 shows another embodiment of the present invention.

FIG. 5 shows another embodiment of the present invention similar to the one in FIG. 4 where the conductor 11 is supported at two points 1, 2 inside the hollow isolator 12 by a supporting body. The the fixation point or the support points are not placed on the longitudinal center line. In FIG. 5, the static deflection at the longitudinal center of the bushing is further lowered by the movement of the fixation points over the solution in FIG. 4 and this creates a moment at the support point. Another embodiment, not shown, is that none of the support points and fixation points are placed on the longitudinal center line. The fixation points are placed below the center line and the support points are placed above the centerline in a way to minimize the static deflection of the conductor at the longitudinal center of the bushing.

Figure 6:
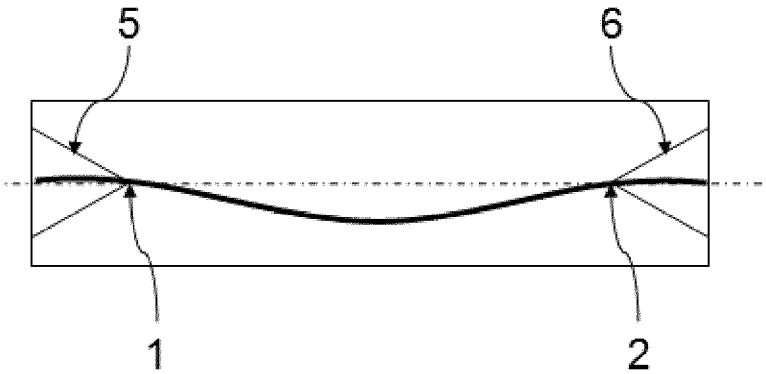
FIG. 6 shows another embodiment of the present invention.

FIG. 6 shows another embodiment of the present invention where the support body is in a form of a conical body 5, 6 arranged around the conductor. The circular end of the support body is fixated on the end flange and the tip of the conical body is the support point. The conical body can be a solid body or it can be a hollow body. The hollow body can be arranged with openings to allow the gas in the gas inside the bushing to circulate to insulate and cool the conductor.

Figure 7A:
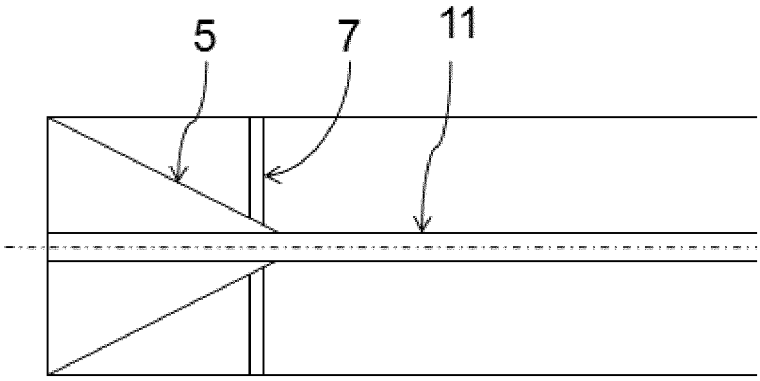
FIG. 7*a-b* shows another embodiment of the support body.
Figure 7B:
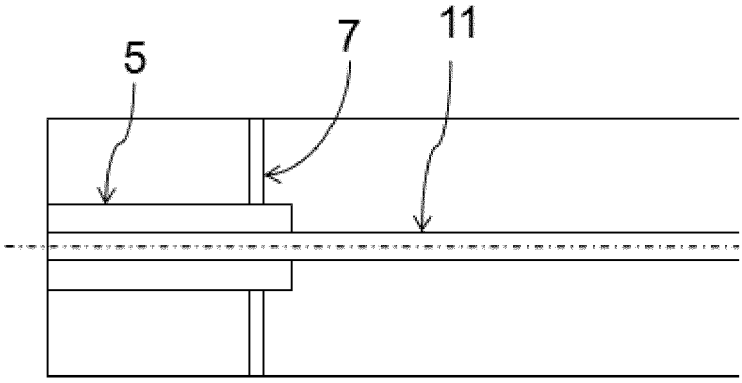

FIG. 7*a* shows another embodiment of the present invention where the support body is in a form of a conical body 5, 6 arranged around the conductor where support members 7 are arranged to support the support body against the inner wall of the hollow conductor. In FIG. 7*b* shows an embodiment where the support body is not a conical body but can be any shape and here the support members 7 are arranged to support the support body against the inner wall of the hollow shell.

The supporting bodies have advantages for reducing the static deflection from gravity and they also have advantages for reducing dynamic deflection e.g. from earthquakes.

The invention claimed is:

1. A high voltage gas isolated bushing comprising:

a tubular shell with two ends, each end of the shell having an end flange creating an enclosed volume, a conductor suspended in the enclosed volume and extending between the two ends of the shell, the conductor having two conductor ends, one conductor end fixed to one end flange at a first fixation point and the other conductor end fixed to the other end flange at a second fixation point and, wherein at least one of the end flanges includes a support body extending into the enclosed volume in a longitudinal direction of the bushing, and the support body is arranged to support the conductor on at least one support point at a distance from the fixation point on the end flange having the support body.

2. The high voltage bushing according to claim 1, wherein the support body is arranged around the conductor and one end of the support body is fixated to the end flange and another end of the support body is provided with an opening for the conductor, where the opening forms the at least one support point.

3. The high voltage bushing according to claim 1, wherein the support body is made from electrically insulating material.

4. The high voltage bushing according to claim 1, wherein the support body is made from fiber reinforced polymer

5. The high voltage bushing according to claim 1, wherein the support body is made from carbon or glass fiber reinforced epoxy.

6. The high voltage bushing according to claim 1, wherein the support body is made from metal.

7. The high voltage bushing according to claim 1, wherein the support body is conically shaped and arranged around the conductor, a round base of the conically shaped body is fixed onto the end flange and the conically shaped body is provided with an opening for the conductor, wherein the opening forms the at least one support point.

8. The high voltage bushing according to claim 1, wherein the tubular shell has a longitudinal center line and the support body is arranged with the support point at a distance from the center line and so that the support point is positioned above the centerline when the bushing is mounted.

9. The high voltage bushing according to claim 1, wherein the tubular shell has a longitudinal center line and at least one of the first and second fixation points is at a distance from the center line and is positioned below the center line when the bushing is mounted.

10. The high voltage bushing according to claim 8, wherein at least one of the first and second fixation points and the support point are positioned on opposite sides of the centerline.

11. The high voltage bushing according to claim 1, wherein the distance between the support point and the end flange is in the interval 0.3-4 m.

12. The high voltage bushing according to claim 1, wherein the support body comprises openings that provide for gas inside the bushing to circulate inside the support body.

13. The high voltage bushing according to claim 1, wherein the bushing is filled with $SF_6$ at an over pressure.

14. The high voltage bushing according to claim 1, wherein the support body is fixated on the end flange and comprises one or more support members, supporting the support body on an inner wall of the tubular shell.

15. The high voltage bushing according to claim 1, wherein both end flanges are provided with support bodies extending into the enclosed volume in the longitudinal direction of the bushing, and the support bodies are arranged to support the conductor at support points at a distance from the fixation points on the end flanges.

* * * * *